US007980969B1

(12) United States Patent
Hochberg

(10) Patent No.: US 7,980,969 B1
(45) Date of Patent: Jul. 19, 2011

(54) MALLEABLE HOCKEY STICK BLADE

(75) Inventor: Seth Hochberg, Plainville, MA (US)

(73) Assignee: Franklin Sports, Inc., Stoughton, MA (US)

( * ) Notice: Subject to any disclaimer, the term of this patent is extended or adjusted under 35 U.S.C. 154(b) by 55 days.

(21) Appl. No.: 12/535,510

(22) Filed: Sep. 11, 2009

(51) Int. Cl.
*A63B 59/14* (2006.01)

(52) U.S. Cl. ..... 473/563

(58) Field of Classification Search ..... 473/560–563
See application file for complete search history.

(56) References Cited

U.S. PATENT DOCUMENTS

| | | | | |
|---|---|---|---|---|
| 3,934,875 | A | 1/1976 | Easton et al. | |
| 4,013,288 | A * | 3/1977 | Goverde | 473/562 |
| 4,059,269 | A | 11/1977 | Tiitola | |
| 4,124,208 | A | 11/1978 | Burns | |
| 4,570,932 | A * | 2/1986 | Cote | 473/563 |
| 4,741,371 | A | 5/1988 | Lord | |
| 4,858,665 | A | 8/1989 | Miller et al. | |
| 5,263,711 | A | 11/1993 | Addis et al. | |
| 5,407,195 | A | 4/1995 | Tiitola et al. | |
| 5,676,608 | A * | 10/1997 | Christian et al. | 473/563 |
| 5,863,268 | A | 1/1999 | Birch | |
| 6,062,996 | A * | 5/2000 | Quigley et al. | 473/563 |
| 6,855,078 | B2 | 2/2005 | Flaum et al. | |
| 6,918,847 | B2 | 7/2005 | Gans et al. | |
| 7,326,136 | B2 * | 2/2008 | Jean et al. | 473/563 |
| 7,914,403 | B2 * | 3/2011 | Ie | 473/563 |
| 2003/0004019 | A1 * | 1/2003 | Lussier et al. | 473/563 |
| 2008/0020872 | A1 * | 1/2008 | Johnson | 473/560 |

* cited by examiner

*Primary Examiner* — Mark S Graham
(74) *Attorney, Agent, or Firm* — Joseph B Bowman

(57) ABSTRACT

A hockey blade having a malleable metal core sandwiched between the lower portions of the front and rear planar striking surfaces fabricated of semi-rigid, but bendable and durable, high strength molded plastic material. The metal core also extends through the molded neck of the blade received within the tubular end of the hockey stick handle. Thus, the blade may be bent along its length to a desired and retained curvature.

6 Claims, 2 Drawing Sheets

MALLEABLE HOCKEY STICK BLADE

CROSS-REFERENCE TO RELATED APPLICATIONS

This application references no related application.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a hockey stick. More specifically, this invention relates to a hockey stick having a malleable blade which can be customized in curvilinear shape to a user's individual specifications.

Many hockey players, like other sports participants, desire custom equipment tailored to their individual preferences. In hockey sticks, the shape and curvature of the blade itself has great influence on a player's handling and shooting a hockey puck. In the case of hockey blades constructed of traditional wood materials, modifications to the blade could be accomplished by carving, steaming, bending and clapping operations until the desired shape and curvature was achieved. This was most often a time consuming process with uncertain outcomes.

Of course strength of the materials used in hockey stick blades is also of critical importance to prevent breakage. Contemporary hockey blades constructed of modern, high strength composite materials have minimized the likelihood of breakage. These advancements, however, have resulted in hockey blades that are rigidly fixed in shape and curvature, and present only limited possibilities for adjustments to a player's individual preferences.

Therefore, a need remains in the field of hockey sticks for a blade having high resistance to breakage while at the same time permitting ease of curvature adjustments without resorting to specialty tools and jigs. The primary goal of this invention is to meet this need.

SUMMARY OF THE INVENTION

More specifically, an object of the invention is to provide a hockey blade fabricated of high strength materials to minimize the inconvenience and safety concerns associated with impact breakage.

Another object of the invention is to provide a hockey blade of the character described which can be easily and repeatedly adjusted in curvature without the need of specialized equipment.

A further object of the invention is to provide a hockey blade of the character described which retains its shape after being adjusted to the individual preferences of the hockey player.

In summary, an object of the invention is to provide a hockey blade having a malleable metal core sandwiched between the lower portions of the front and rear planar striking surfaces fabricated of semi-rigid, but bendable and durable, high strength molded plastic material. The metal core also extends through the molded neck of the blade received within the tubular end of the hockey stick handle. Thus, the blade may be bent along its length to a desired and retained curvature.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
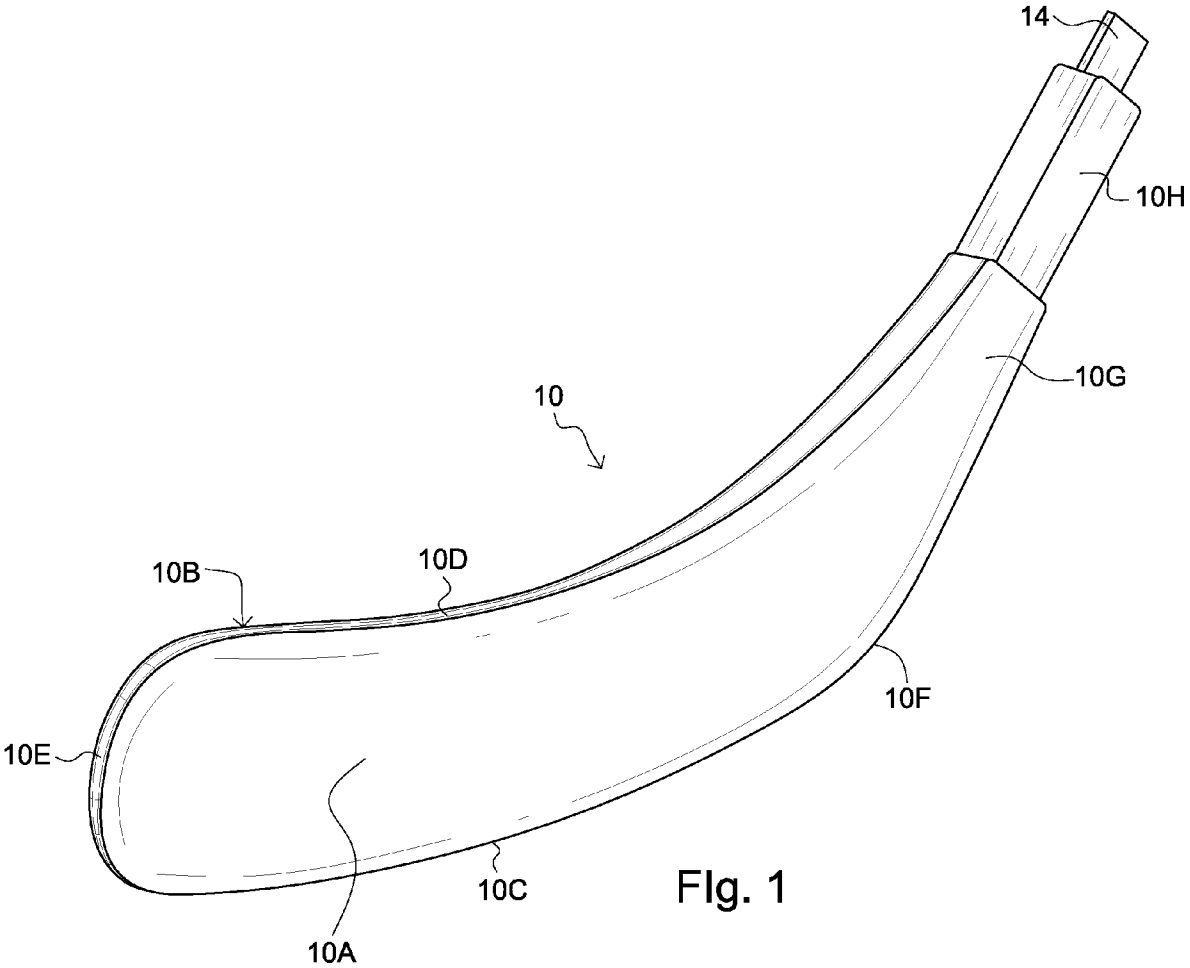
FIG. 1 is a perspective view of a hockey blade constructed in accordance with one embodiment of the invention.

Referring to the drawings in greater detail, attention is first directed to the illustration of FIG. 1 showing a perspective view of a hockey blade designated generally by the numeral 10. The blade 10 may be formed in a conventional length and height common to traditional hockey blades. It includes front and rear striking surfaces 10*a* & 10*b*, respectively, for engaging a hockey puck (not shown). The front and rear striking surfaces 10*a* & 10*b* can also be thought of as left and right striking surfaces 10*a* & 10*b* relative to the player when the lower edge 10*c* of the blade rest on the ice or ground in front of the player. The height of the blade 10 extends from the lower edge 10*c* to the upper edge 10*d*. The length of the blade 10 extends generally from the toe 10*e* to the heel region 10*f*. From the heel 10*f* the blade angles upwardly to a tapered neck section 10*g*. The neck section 10*g* terminates as rectangularly molded receiver post 10*h*.

The material of construction forming the variously referenced parts 10*a-h* of the blade 10 is preferably a semi-rigid, but bendable plastic of sufficient durability to resist the normal abrasion and impacts associated with ice or street hockey play. Therefore, a variety of thermal setting, molding polymer plastics known to those skilled in the molding arts are useful in the construction of the blade 10.

Figures 2, 3:
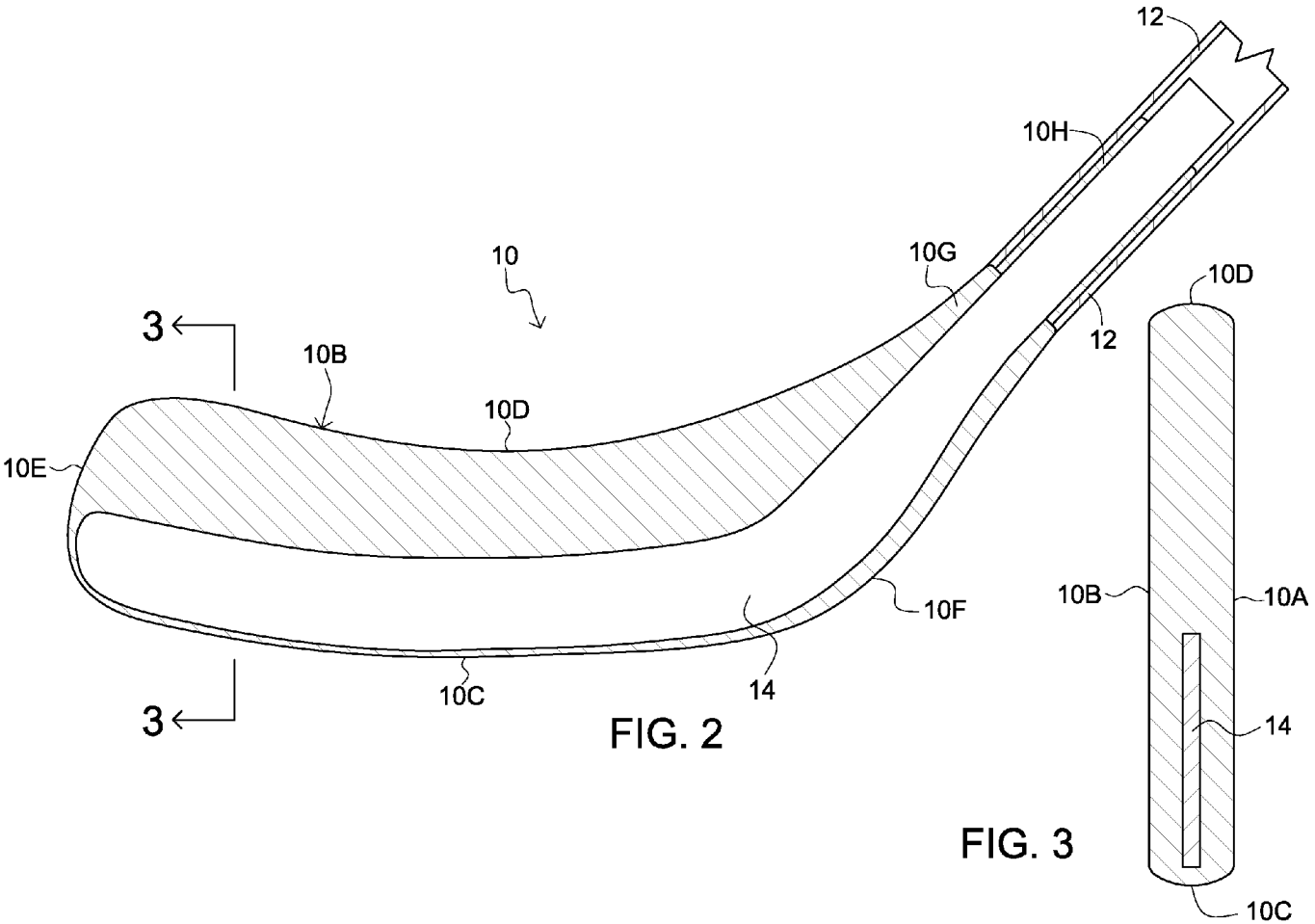
FIG. 2 is a side elevational view, partially sectional, of the hockey blade illustrated in FIG. 1.
FIG. 3 is an enlarged, sectional view taken along line 3-3 of FIG. 2 in the direction of the arrows.

Referring then to the side sectional view of FIG. 2, the receiver post 10*h* of the blade 10 is disposed within, and bonded to, the hollow end socket of a conventional hockey stick handle 12. Only a portion of the handle 12 is illustrated but it will be understood that the length thereof is appropriate as needed according to the user's height and personal preference. The material of construction for the handle 12 may typically be a rigid, durable plastic or a carbon fiber composite having superior break resistant characteristics.

Encapsulated within the blade 10 between the front and rear striking surfaces 10*a* & 10*b* is a malleable sheet metal core 14. Throughout the length of the blade 10 from the toe 10*e* to the heel 10*f*, the core 14 is located in the lower portion thereof inset slightly from the lower edge 10*c*. In height, the core 14 is less than half the height of the blade 10 from the lower edge 10*c* to the upper edge 10*d* thereof. In thickness, the core 14 is less than half the thickness of the blade 10 between the front and rear striking surfaces 10*a* & 10*b* as illustrated in FIG. 3.

In order to strengthen the neck region 10*g* and receiver post 10*h* of the blade 10, the core 14 preferably extends upwardly at an angle from the heel region 10*f*. In the neck region 10*g* and receiver post 10*h* only, the core 14 represents a substantial portion of the height distance in order to resistance downward breaking forces in the neck area of the blade where it joins the hockey stick handle 12.

In operation, the blade 10 and core 14 assemblage as described is glued or otherwise bonded to the hockey stick handle 12. With the appropriate application of side pressure, the blade 10 and core 14 may be shaped along the length thereof to a desirable shape. Thus the blade 10 may be angled to right or to the left relative to the handle 12 as the user requires. Moreover, the blade 10 may be cupped into a right or left concave curvature along its length. The shape selected by the user is therefore retained during play by the blade 10 and captured core 14 assembly. At any time, the user can further alter the shape by applying bending pressure to the appropriate area of the blade.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A hockey stick comprising:

a blade member having length, height and thickness, and having first and second planar striking surfaces along the length thereof, said blade member formed of semi-rigid and bendable thermal setting plastic;

a neck portion integrally molded as part of said blade member and tapered upwardly from said first and second striking surfaces at an angle with respect to the length of said blade member;

an elongate handle joined to said neck portion of said blade member; and a continuous, nonporous, malleable sheet metal core of single layer, uniform thickness completely encapsulated within said blade member which extends substantially throughout the length of said blade member and throughout only a portion of the height of said blade member, said core having a thickness less than at least half said thickness of said blade member and having a height less than at least half said height of said blade member, said core being deformable along the length of said blade member whereby said blade member may be caused to conform to and retain a variety of curvilinear shapes for said first and second striking surfaces.

2. The hockey stick as in claim 1, said metal core being formed of sheet steel.

3. The hockey stick as in claim 1, said metal core extending through said length of said blade member and upwardly through said neck portion in order to strengthen the joint between said blade member and said handle.

4. A blade for a tubular hockey stick handle comprising:

a blade member having length, height and thickness, and having first and second planar striking surfaces along the length thereof, said blade member formed of semi-rigid and bendable thermal setting plastic;

a neck portion integrally molded as part of said blade member and tapered upwardly from said first and second striking surfaces at an angle with respect to the length of said blade member, said neck portion being formed for connection to a tubular hockey stick; and a continuous, nonporous, malleable sheet metal core of single layer, uniform thickness completely encapsulated within said blade member which extends substantially throughout the length of said blade member and throughout only a portion of the height of said blade member, said core having a thickness less than at least half said thickness of said blade member and having a height less than at least half said height of said blade member, said core being deformable along the length of said blade member whereby said blade member may be caused to conform to and retain a variety of curvilinear shapes for said first and second striking surfaces.

5. The blade as in claim 4, said metal core being formed of sheet steel.

6. The blade as in claim 4, said metal core extending through said length of said blade member and upwardly through said neck portion in order to strengthen the joint between said blade member and said handle.

* * * * *